US006862990B2

(12) United States Patent
Göttling et al.

(10) Patent No.: US 6,862,990 B2
(45) Date of Patent: Mar. 8, 2005

(54) CYLINDER OF A ROTARY PRINTING MACHINE

(76) Inventors: Josef Göttling, Achstrasse 11, D-86316 Friedberg (DE); Godber Petersen, Zeppelinstrasse 22, D-86159 Augsburg (DE)

( * ) Notice: Subject to any disclaimer, the term of this patent is extended or adjusted under 35 U.S.C. 154(b) by 0 days.

(21) Appl. No.: 10/733,496

(22) Filed: Dec. 10, 2003

(65) Prior Publication Data

US 2004/0123754 A1 Jul. 1, 2004

Related U.S. Application Data

(63) Continuation of application No. 09/790,294, filed on Feb. 22, 2001, now Pat. No. 6,725,774.

(30) Foreign Application Priority Data

Feb. 23, 2000 (DE) ..... 100 08 218

(51) Int. Cl.[7] ..... B41F 13/10

(52) U.S. Cl. ..... 101/375; 101/376; 101/216; 101/378; 492/47

(58) Field of Search ..... 101/375, 376, 101/216, 378; 492/47

(56) References Cited

U.S. PATENT DOCUMENTS 5,351,616 A 10/1994 Gelinas et al.
5,840,386 A * 11/1998 Hatch et al. ..... 428/36.9
5,904,095 A * 5/1999 Nelson ..... 101/375
6,085,650 A 7/2000 Petersen
6,186,065 B1 * 2/2001 Kersch et al. ..... 101/216

FOREIGN PATENT DOCUMENTS

| | | |
|---|---|---|
| DE | 897 107 | 10/1953 |
| DE | 27 00 118 | 7/1977 |
| DE | 195 34 651 A1 | 9/1995 |
| DE | 296 01 151 U1 | 1/1996 |
| DE | 296 01 151 U1 | 5/1996 |
| DE | 296 17 401 U1 | 10/1996 |
| DE | 195 27 761 A1 | 1/1997 |
| DE | 198 05 898 A1 | 11/1999 |
| DE | 198 48 184 | 5/2000 |
| EP | 0 586 881 A2 | 8/1993 |
| EP | 058 6 881 A2 | 3/1994 |

* cited by examiner

*Primary Examiner*—Andrew H. Hirshfeld
*Assistant Examiner*—Kevin D. Williams

(57) ABSTRACT

In order to manufacture a cylinder of a rotary printing machine cost-effectively, its cylinder body is assembled from a cylinder casing and a first and second side part located at the ends of the cylinder casing, one and the same first and second side part being capable of being completed in order to produce different cylinders casings of different outside diameters.

8 Claims, 2 Drawing Sheets

11
12
7
4
15
13
23
1
16
8,9
14
6
22
21
a
a'
2'
2
3
7
10
18
19
5
17
20
8,9

7
22
4
2

CYLINDER OF A ROTARY PRINTING MACHINE

CROSS-REFERENCE TO RELATED APPLICATIONS

This application is a continuation of application Ser. No. 09/790,294, filed on Feb. 22, 2001. Now U.S. Pat. No. 6,725,794. Priority is claimed on that application and on a corresponding application filed in Germany on Feb. 23, 2000, No. 100 08 218.1.

BACKGROUND OF THE INVENTION

1. Field of the Invention

The invention relates to a cylinder of a rotary printing machine, in particular a forme or transfer cylinder.

2. Description of the Related Art

DE-C 897 107 shows a forme cylinder of a rotary printing machine. This cylinder contains a cast cylinder body, which is slipped onto a shaft and is secured axially between cones. One disadvantage of this is that, in order to produce cylinders of different diameters, corresponding models are necessary in each case, thus entailing high manufacturing costs.

SUMMARY OF THE INVENTION

The object of the invention is to provide a cylinder which can be manufactured cost-effectively.

The object is achieved by a cylinder comprising a cylinder casing, and first and second side parts disposed at opposite ends of the cylinder casing and attached therewith. The cylinder and side end parts define a cylinder body assembly. The side parts can be used with cylinder casings of a plurality of diameters. The invention is concerned with the assembly technique in the production of the cylinder. The casting process, along with the need for models, is bypassed as a result. The welding technique, with the risk of distortion-induced manufacturing inaccuracies, is also avoided. The cylinder can thereby be produced cost-effectively. Moreover, the capacity for universal use of the side parts for the production of cylinders of different diameters additionally lowers the manufacturing costs.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
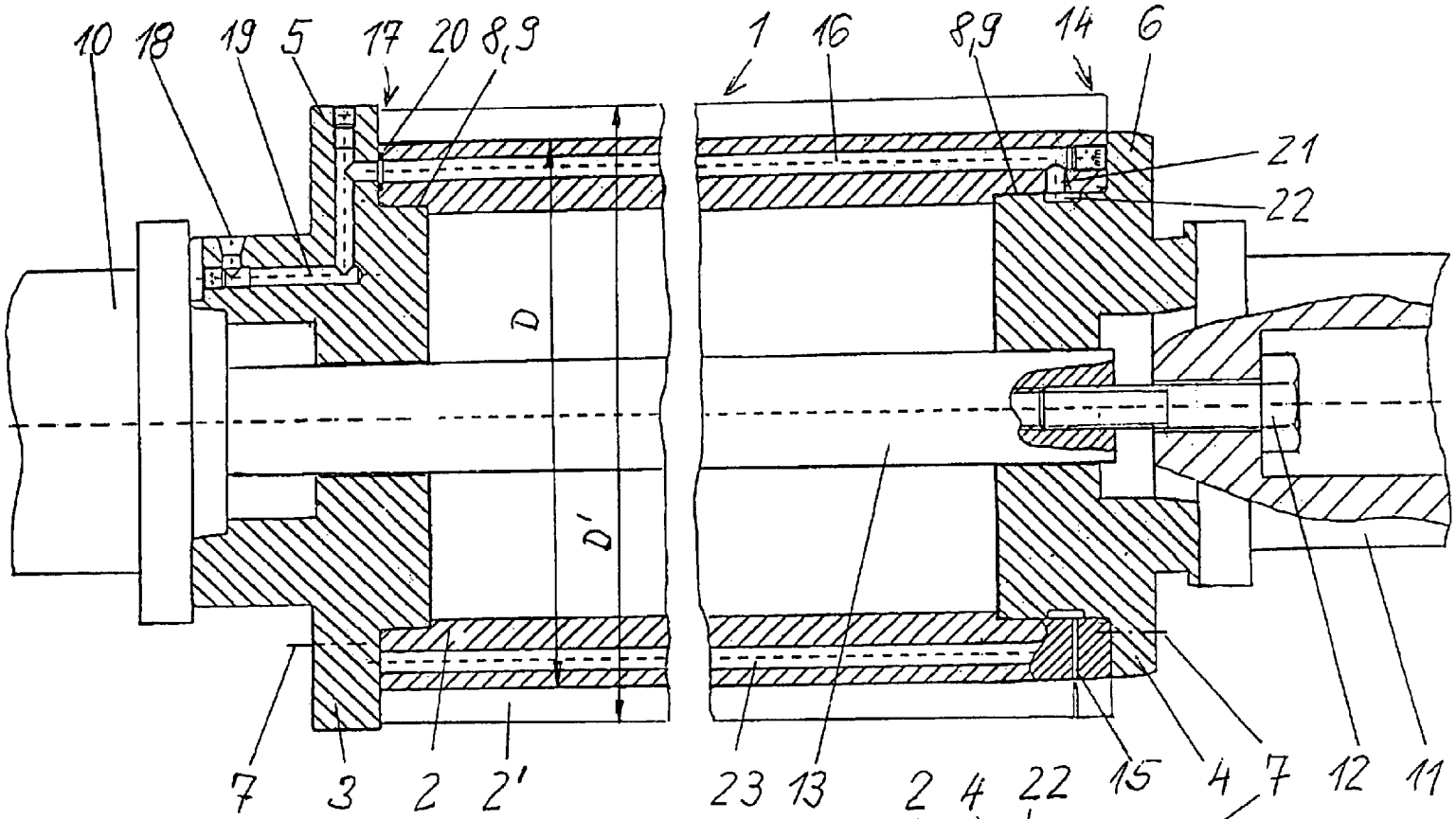
FIG. 1 shows a cylinder of the invention in longitudinal section.
Figure 2:
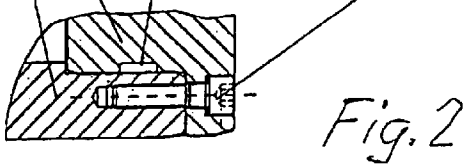
FIG. 2 is an enlarged fragmentary section view showing the manner of connecting the second side part with the cylinder casing.

FIG. 1 shows a cylinder of a rotary printing machine, specifically a forme cylinder. The cylinder body 1 of the cylinder consists of a cylinder casing 2 and first and second side parts 3, 4. The two side parts 3, 4 are mounted at the ends of the cylinder casing 2, and they rest in each case with respective side part collars 5, 6 against the end faces of the cylinder casing 2. The two side parts 3, 4 are screwed down by means of screws 7 screwed axially into the cylinder casing 2. FIG. 2 shows the screw connection of side part 4 to the cylinder casing. An identical screw connection is provided for fastening the first side part 3 to the cylinder casing. The two side parts 3, 4 are each centered relative to the cylinder casing 2 with a fit between an outside diameter of a side part shoulder 8 and an inside diameter of an annular groove 9 in the cylinder casing. The outside diameter structure can be that of one of the side parts and the cylinder casing and the inside diameter structure then would be of a other of the cylinder casing and the side parts.

A first journal 10 is screwed to the first side part 3. The two parts 3, 10 are centered by means of a pairing of cones and are drive-connected positively to one another by means of a pin fastened to the first journal 10 and projecting in a bore of the first side part 3. This positive connection is not illustrated. In this regard and with regard to further possibilities for the connection of journals, reference is made to patent application DE 198 48 184.5 which is to be considered as belonging to the present description. The second journal 11 is fastened to the second side part 4. The fastening is carried out in such a way that the second journal 11 is inserted into the second side part 4 by means of a cone fit and is drawn firmly onto the second side part 4 by means of a screw 12 which is inserted through the bottom of the second journal 11 and is screwed into a journal rod 13 fastened to the first journal 10, rod 13 having an end with a thread bore length for such purpose. The journals 10, 11 have hubs which bear against the outer ends of the side parts. Consequently, the complete cylinder body 1 can be pushed onto the rod 13 and, after the second journal 11 is inserted and the screw 12 screwed in, firmly connected to the two journals 10, 11, the side parts 3, 4 being centered coaxially with the cylinder casing 2. The cylinder, if equipped only with the first journal 10, may also be mounted in an overhung manner. In this case, instead of the second journal 11, a closing disc may be provided on the second side part 4, the screw 12 being inserted through said closing disc and being screwed into the rod 13. The flange of the first journal 10 could also be screwed directly to the first side part.

The cylinder shown in FIG. 1 is designed for receiving a sleeve-shaped printing forme (not illustrated). So that a sleeve of this type can be pushed on from a second end region 14 of the cylinder body 1, the cylinder body 1 has, in this second end region 14, radial blowing bores 15, out of which compressed air can be blown for the elastic expansion of the printing-forme sleeve. To supply the blowing bores 15 with compressed air, the cylinder casing 2 contains a longitudinal bore or passage 16 which runs in the axial direction and which is connected to a compressed-air supply in a first end region 17 located opposite the second end region 14 of the cylinder casing 2. In particular, the first side part 3 has a connecting bore 18 which is connected to the longitudinal bore 16 via a feed line 19. The joint between the first side part 3 and the cylinder casing 2 is sealed off by means of the sealing ring 20. In a second end region 14 of the cylinder casing 2, the longitudinal bore or passage 16 is connected via a radial bore 21 to an annular encircling groove 22 of the second side part 4, the radial blowing bores 15 issuing into the said annular groove. A component supplying compressed air can be placed onto the connecting bore 18. The compressed air introduced there can be conducted to the blowing bores 15 via the feed line 19, longitudinal bore 16, radial bore 21 and annular groove 22.

The cylinder casing 2 carries, opposite the longitudinal bore 16, a further longitudinal bore 23 for the purpose of mass compensation.

Cylinders of different diameters can also be produced by means of the side parts 3, 4, by these being mounted together with a cylinder casing 2' (depicted by thin lines) of diameter D', instead of together with a cylinder casing 2 of diameter D. It is also possible to vary the length of the cylinder casing 2 and therefore the width of the cylinder body 1.

Figure 3:
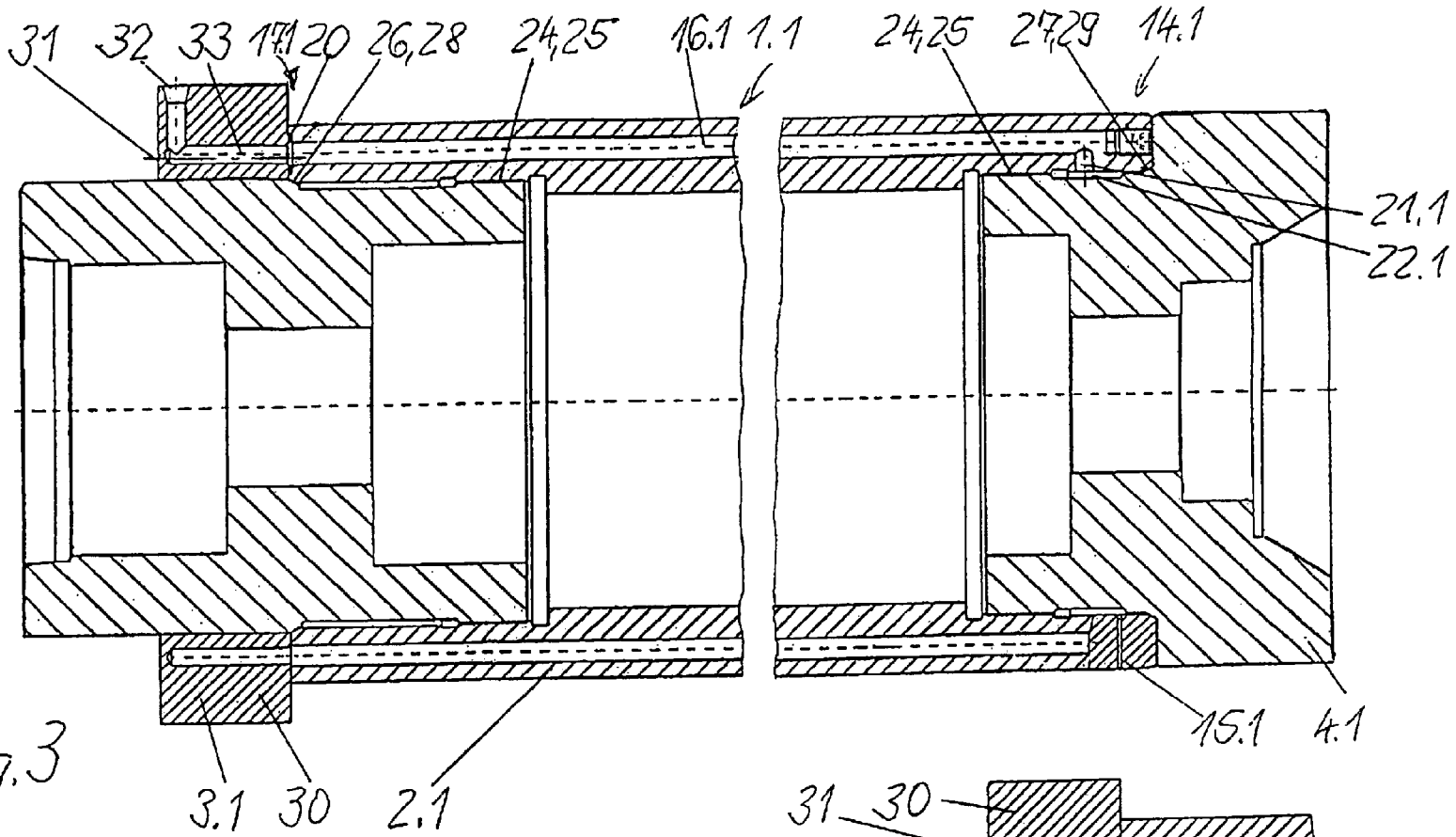
FIG. 3 is a longitudinal section view of another embodiment of the cylinder, journals used therewith not being shown.

FIG. 3 shows a further design of the cylinder. For the sake of simplicity, essentially the reference symbols of the cylinder just described are retained, or supplemented by the addition "0.1", for identical structural parts. In order to avoid repetition, journals of the cylinder have not been illustrated. The cylinder may be, for example, a transfer cylinder of a rotary printing machine, on which a sleeve-shaped rubber blanket can be tensioned. The cylinder body 1.1 illustrated contains a cylinder casing 2.1, at the ends of which in each case a first and a second side part 3.1, 4.1 are mounted. Each side part 3.1, 4.1 has a shoulder which carries an external thread 24 and by means of which it is screwed into an internal thread 25 of the cylinder casing 2.1, the respective side part 3.1, 4.1 bearing with an outer cone 26, 27 against an inner cone 28, 29 of the cylinder casing 2.1. Conversely, the outer cones may also be assigned to the cylinder body 2.1 and the inner cones to the side parts 3.1, 4.1.

The cylinder casing 2.1 has a longitudinal bore 16.1 which, in a second end region 14.1 of the cylinder casing 2.1, is connected to an annular groove 22.1 in the second side part 4.1 via a radial bore 21.1, radial blowing bores 15.1 issuing into the said annular groove. In the first end region 17.1 located opposite the second end region 14.1, a longitudinal bore 16.1 is connected to a compressed-air supply. The latter is arranged in a ring 30 which is screwed on the end face to a cylinder casing 2.1 in the first end region 17.1 by means of screws 31.

Figure 4:
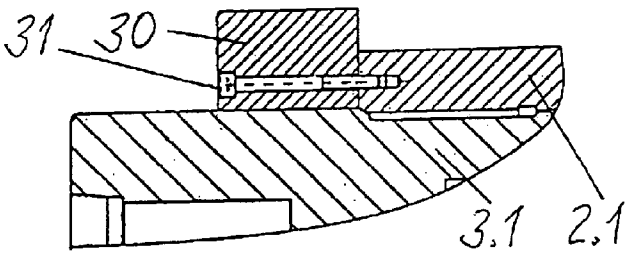
FIG. 4 is an enlarged fragmentary section view, showing connection of a first side part having a compressed air bore to an end face of the cylinder casing.

FIG. 4 shows a section through the ring 30 in a plane containing a screw 31. The compressed-air supply in the ring 30 contains, in particular, a connecting bore passage 32 which is connected to the longitudinal bore 16.1 via a feed line 33. The connection of the feed line 33 to the longitudinal bore 16.1 is sealed off by means of a seal 20.

A supply component for compressed air is capable of being placed onto the connecting bore 32, said compressed air being conducted to the blowing bores 15.1 via the feed line 33, longitudinal bore 16.1, radial bore 21.1 and annular groove 22.1. The compressed air emerging there serves for the elastic expansion of the rubber sleeve to be pushed on (not illustrated).

As described in relation to FIG. 1, the side parts 3.1, 4.1 may also be completed by cylinder casings of a different diameter and/or of a different length.

The invention is not restricted to the production of forme or transfer cylinders. Other cylinders of printing machines, for example cylinders of inking or dampening units, may also be produced by the method of assembly described.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A cylinder for a rotary printing machine comprising:

a cylinder casing; and first and second side parts disposed at opposite ends of said cylinder casing attached therewith and defining with said side parts a cylinder body assembly, said first side part having a first outer diameter and said second side part having a second outer diameter, said second diameter being larger than said first diameter, said cylinder casing being one selected from a plurality of cylinder casings of different outside diameters to each of which said side parts can be attached, wherein an outer diameter of said cylinder casing is greater than or equal to said first diameter and less than said second diameter; and first and second journals respectively connected to said first and second side parts.

2. A cylinder according to claim 1, wherein each of said side parts has a collar, the collars bearing against respective ones of the ends of said cylinder casing and being screwed thereto, said side parts being centered coaxially with said cylinder casing in a fit therewith wherein outside diameter structure on one of said side parts and said cylinder casing engages with inside diameter structure on a other one of said side parts and said cylinder casing.

3. A cylinder according to claim 1, comprising:

external cone surfaces on one of said side parts and said cylinder casing, and internal cone surfaces on a other of said side parts and said cylinder casing, said side parts being screwed to said cylinder casing to urge the external cone surfaces into engaged pairing with the internal cone surfaces.

4. A cylinder according to claim 2, wherein said collars are screwed to end faces of the cylinder casing with screws.

5. A cylinder according to claim 3, wherein said collars are screwed to end faces of the cylinder casing with screws.

6. A cylinder according to claim 2, wherein each of said side parts has an externally threaded shoulder, said cylinder casing having internal threaded surfaces with which said external threaded shoulders are engageable for screwing said side parts to said cylinder casing.

7. A cylinder according to claim 3, wherein each of said side parts has an externally threaded shoulder, said cylinder casing having internal threaded surfaces with which said external threaded shoulders are engageable for screwing said side parts to said cylinder casing.

8. A cylinder according to claim 1, comprising:

a first journal including a hub and a rod, said hub being disposed at an outer end of said first side part, said rod passing through a center bore in said first side part and through a center bore in said second side part;

a second journal including a hub, said second journal hub being disposed at an outer end of said second side part; and a tightening screw passing through a center bore of said second side part and engaging threads in a bore of said first journal rod for urging said first and second journals against the outer ends of the said first and second parts, respectively.

* * * * *